US009968165B1

(12) United States Patent
Ramadhan

(10) Patent No.: US 9,968,165 B1
(45) Date of Patent: May 15, 2018

(54) KEY FOB PROTECTOR

(71) Applicant: Fatima J. Ramadhan, Buffalo, NY (US)

(72) Inventor: Fatima J. Ramadhan, Buffalo, NY (US)

( * ) Notice: Subject to any disclaimer, the term of this patent is extended or adjusted under 35 U.S.C. 154(b) by 196 days.

(21) Appl. No.: 15/184,002

(22) Filed: Jun. 16, 2016

Related U.S. Application Data

(60) Provisional application No. 62/191,003, filed on Aug. 24, 2015.

(51) Int. Cl.
*A45C 11/32* (2006.01)
*A44B 15/00* (2006.01)
*E05B 19/00* (2006.01)

(52) U.S. Cl.
CPC ..... *A44B 15/005* (2013.01); *E05B 19/0082* (2013.01)

(58) Field of Classification Search
USPC ..... 206/37.1, 37.3, 37.4, 37.5, 38.1, 305, 206/320; 70/457, 458, 459; 200/4.24; 150/165
See application file for complete search history.

(56) References Cited

U.S. PATENT DOCUMENTS 2,527,175 A * 10/1950 Brill ..... A45C 11/32 206/37.1
2,849,044 A * 8/1958 Reitzel ..... A45C 11/323 206/37.1
2,878,851 A * 3/1959 Nash ..... A45C 11/323 206/37.7
3,529,649 A * 9/1970 Bennett ..... A45C 11/325 206/37.1
4,741,434 A * 5/1988 Liebman ..... A44B 15/005 206/38
5,388,691 A * 2/1995 White ..... A45C 11/00 206/305
5,511,390 A * 4/1996 Mah ..... A44C 25/00 206/37.1
5,850,754 A * 12/1998 Dobbins ..... A44B 15/005 206/305
5,865,307 A * 2/1999 Friedman ..... A45C 11/326 206/37.1
6,659,274 B2 * 12/2003 Enners ..... G06F 1/1626 206/305
6,786,332 B1 * 9/2004 Patrick ..... A44B 15/005 206/305
6,948,614 B1 9/2005 Hall et al.
7,248,201 B2 7/2007 Buccinna et al.
7,441,651 B1 10/2008 Sullivan
8,096,412 B1 * 1/2012 Britt ..... A45C 11/32 206/305
9,672,669 B1 * 6/2017 Canastra ..... G07C 9/00119
(Continued)

*Primary Examiner* — Jacob K Ackun

(57) ABSTRACT

A key fob protector for use with an electronic key fob that prevents inadvertently unlocking a vehicle door by covering a plurality of control buttons on a key fob so that no buttons are activated when the key fob is stowed in a bag, purse or pocket. The key fob protector has a gap, exposing a panic button, so that the panic button can easily be activated in an emergency situation without opening the cover. The key fob protector is easily installed using a strap that wraps around the key fob securing the key fob protector in place when the strap is fastened.

19 Claims, 3 Drawing Sheets

(56) References Cited

U.S. PATENT DOCUMENTS

| | | | | |
|---|---|---|---|---|
| 2002/0008610 | A1 | 1/2002 | Peterson | |
| 2006/0081484 | A1* | 4/2006 | Smith | A45C 11/321 206/38.1 |
| 2006/0227031 | A1* | 10/2006 | Benbow | G07C 9/00944 341/176 |
| 2007/0044997 | A1* | 3/2007 | Schumacher | B60R 25/24 174/135 |
| 2007/0221511 | A1* | 9/2007 | Hetzel | A45C 11/32 206/38 |
| 2008/0006556 | A1* | 1/2008 | Bhuchar | A45C 11/00 206/457 |
| 2009/0040874 | A1* | 2/2009 | Rooney | A61J 7/0472 368/10 |
| 2011/0007463 | A1* | 1/2011 | Hodges | H05K 5/0239 361/679.01 |
| 2012/0252230 | A1* | 10/2012 | Alameh | H04M 1/0256 439/31 |
| 2017/0092025 | A1* | 3/2017 | Little | G07C 9/00007 |

* cited by examiner

KEY FOB PROTECTOR

CROSS-REFERENCE TO RELATED APPLICATIONS

This application is a nonprovisional utility application of the provisional patent application, Ser. No. 62/191,003, filed in the United States Patent Office on Aug. 24, 2015 and claims the priority thereof and is expressly incorporated herein by reference in its entirety.

TECHNICAL FIELD

The present disclosure relates generally to a key accessory. More particularly, the present disclosure relates to an electronic key fob protector.

BACKGROUND

Many vehicles on the road today have a keyless entry system that allows a driver to remotely unlock and lock doors, open sliding side doors on vans, pop trunk lids and hatch doors and even start engines. These actions are controlled by pressing buttons on a key fob that electronically communicates with the vehicle.

While there are many advantages to being able to perform these tasks remotely, there is a danger that these actions could be started unintentionally by an accidental pressing of a button.

Sometimes when the key fob is placed in a handbag or pocket, other things in the handbag or pocket can hit a button. Small children are attracted to these fobs and may play with the buttons without realizing the consequences. Someone struggling with many packages, small children and strollers may inadvertently squeeze a button while holding the fob in their hand.

Unintentionally pressing a button can leave a vehicle unlocked, inviting auto and property theft. A sliding door on a van could inadvertently crush someone if the safety mechanism malfunctions and does not stop the door in time.

In the present disclosure, where a document, act or item of knowledge is referred to or discussed, this reference or discussion is not an admission that the document, act or item of knowledge or any combination thereof was at the priority date, publicly available, known to the public, part of common general knowledge or otherwise constitutes prior art under the applicable statutory provisions; or is known to be relevant to an attempt to solve any problem with which the present disclosure is concerned.

While certain aspects of conventional technologies are discussed to facilitate the present disclosure, no technical aspects are disclaimed and it is contemplated that the claims may encompass one or more of the conventional technical aspects discussed herein.

BRIEF SUMMARY

An aspect of an example embodiment in the present disclosure is to provide security and safety when using an electronic key fob. Accordingly, an aspect of an example embodiment in the present disclosure provides a key fob protector that prevents inadvertently unlocking a vehicle door.

Another aspect of an example embodiment in the present disclosure is to provide safety and security when using the electronic key fob when stowing the key fob in a purse, bag or pocket. Accordingly, the present disclosure provides a key fob protector that covers the control buttons on a key fob so that no buttons are activated when the key fob is stowed.

A further aspect of an example embodiment in the present disclosure is to provide security and safety when using an electronic key fob in an emergency situation. Accordingly, the present disclosure provides a key fob protector that covers the control buttons on the key fob but has a gap, exposing a panic button, so that the panic button can easily be activated in an emergency situation.

Yet another aspect of an example embodiment in the present disclosure is to provide a key fob protector that easily installs onto a key fob. Accordingly, the present disclosure provides a key fob protector with a strap that wraps around the key fob securing the key fob protector in place when the strap is fastened.

The present disclosure describes a key fob protector for use with an electronic key fob that prevents inadvertently unlocking a vehicle door by covering a plurality of control buttons on a key fob so that no buttons are activated when the key fob is stowed in a bag, purse or pocket. The key fob protector has a gap, exposing a panic button, so that the panic button can easily be activated in an emergency situation without opening the cover. The key fob protector is easily installed using a strap that wraps around the key fob securing the key fob protector in place when the strap is fastened.

The present disclosure addresses at least one of the foregoing disadvantages described herein. However, it is contemplated that the present disclosure may prove useful in addressing other problems and deficiencies in a number of technical areas. Therefore, the claims should not necessarily be construed as limited to addressing any of the particular problems or deficiencies discussed hereinabove. To the accomplishment of the above, this disclosure may be embodied in the form illustrated in the accompanying drawings. Attention is called to the fact, however, that the drawings are illustrative only. Variations are contemplated as being part of the disclosure.

BRIEF DESCRIPTION OF THE DRAWINGS

In the drawings, like elements are depicted by like reference numerals. The drawings are briefly described as follows.

Figure 1:
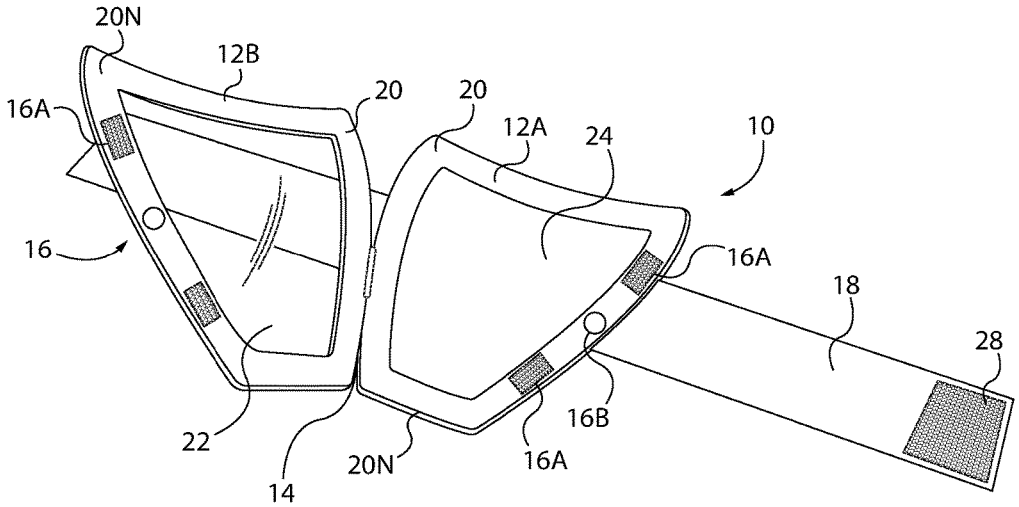
FIG. 1 is a perspective view of an example embodiment of an open key fob protector.
Figure 2:
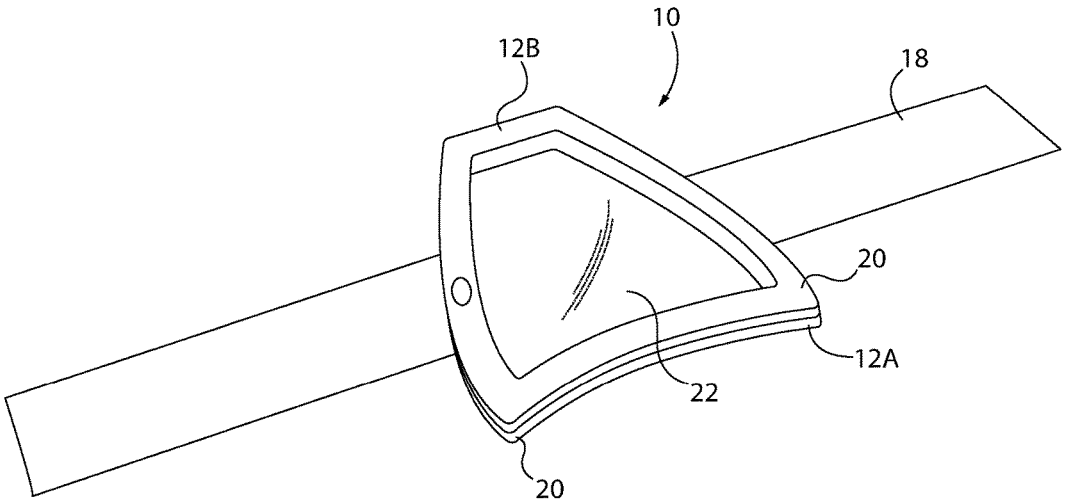
FIG. 2 is a perspective view of an example embodiment of a closed key fob protector.
Figure 3:
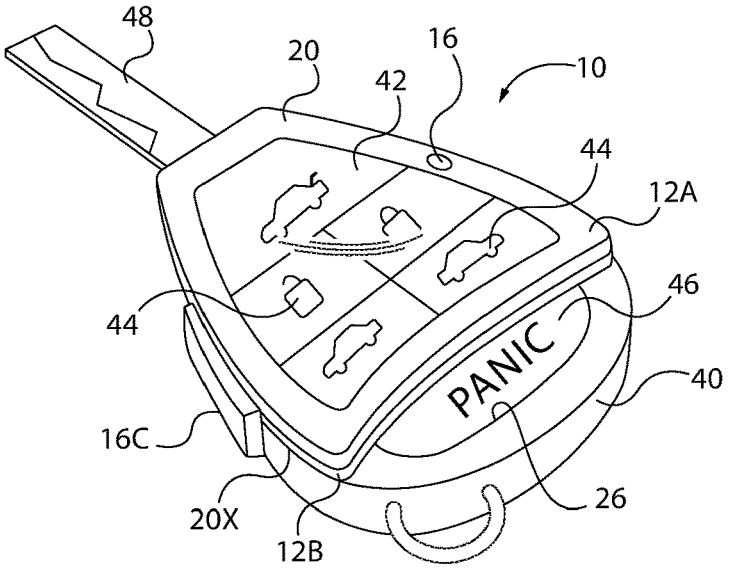
FIG. 3 is a perspective view of an example embodiment of the closed key fob protector on a key fob.
Figure 4:
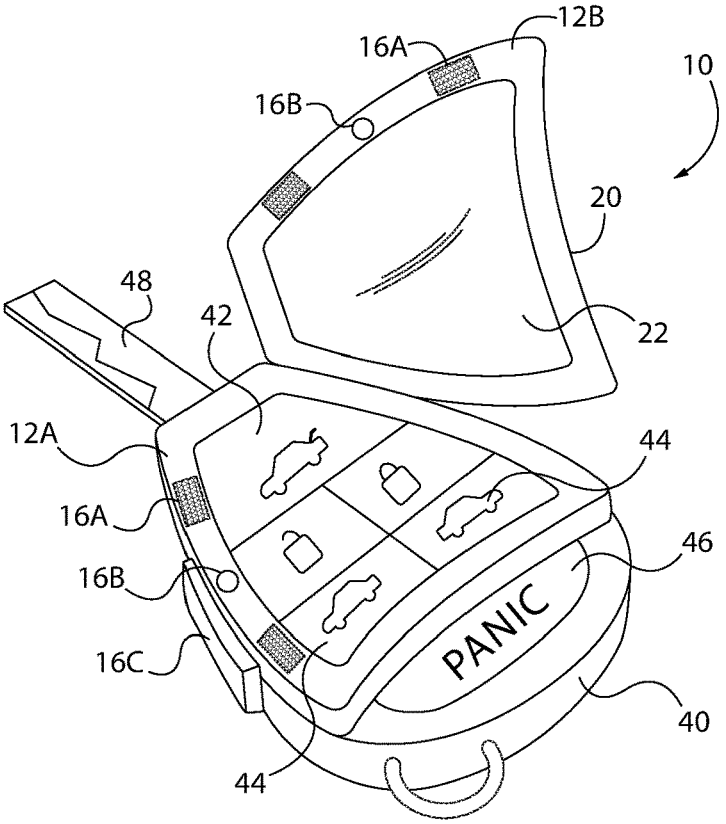
FIG. 4 is a perspective view of an example embodiment of the open key fob protector on the key fob.

The present disclosure now will be described more fully hereinafter with reference to the accompanying drawings, which show various example embodiments. However, the present disclosure may be embodied in many different forms and should not be construed as limited to the example embodiments set forth herein. Rather, these example embodiments are provided so that the present disclosure is thorough, complete and fully conveys the scope of the present disclosure to those skilled in the art.

DETAILED DESCRIPTION OF THE PREFERRED EMBODIMENTS

FIGS. 1-4 illustrate an example embodiment of a key fob protector 10 for placing on an electronic key fob 40. The key fob protector 10 prevents a button 44 on a key fob 40 from being accidently pressed. The key fob protector 10 has a pair of frames, a first frame 12A that attaches to the key fob 40 and a second frame 12B that is hingedly attaching to the first frame 12A by a hinge 14.

The first frame 12A has an opening 24 defined by a rim 20. The opening 24 exposes a plurality of control buttons 44 on a key fob face 42.

The second frame 12B has a cover 22 within a rim 20. The rim 20 on the second frame 12B is the mirror image of the rim 20 on the first frame and vice versa.

The second frame 12B covers over the key fob face 42 by rotating over until the second frame 12B contacts the first frame 12. In one embodiment, the cover 22 is a transparent window.

The first frame 12A and the second frame 12B lock together by a fastener 16 when the second frame 12B closes over the key fob 40, shutting the key fob protector 10. The drawings show multiple embodiments of the fastener 16 for illustrative purposes, but it is understood by those of ordinary skill in the art that only one fastener embodiment is necessary. However, it is possible to have more than one fastener embodiment within the inventive concept. The rim 20 on the first frame 12A has at least one fastener 16 matched to at least one fastener 16 on the second frame 12B.

In a further example embodiment, the rim 20 of the key fob protector 10 has an inside surface 20N.

In one example embodiment, the fastener 16 is a hook and loop fastener 16A with a plurality of hook and loop material strips 16A on the inside surfaces 20N of the rims 20.

In one example embodiment, the rims 20 have a pair of matched magnets 16B that fasten the frames together. In another example embodiment, a sliding latch fastener 16C on the first frame 12A connects to an internal keep, which is not shown, on the second frame 12B.

There are other example embodiments of fasteners 16 known to those of ordinary skill in the art that are equivalent and fit within the inventive concept, such as snaps, buttons and clasps.

In one example embodiment, a two-piece strap 18 attaches to the first frame 12A, the frame 12A having two opposing sides, one section of the strap 18 on each side of the first frame 12A. The strap 18 has a fastener 28 configured to join the strap 18 around the key fob 40.

In another example embodiment, the strap 18 is a unitary elastic strip that slips over the key fob 40, connecting to the first frame 12A on the two opposing sides.

The two sections of the strap 18 wrap around the key fob 40 with the first frame 12A in place over the key fob face 42. In one example embodiment, the two sections of attach together with a hook and loop closure 28. In other example embodiments, the strap 18 sections tie together. Other strap fasteners 28 known to those of ordinary skill, such as snaps, buckles and clasps are envisioned within the inventive concept.

In another example embodiment the cover 22 in second frame is pliable such that with intentional pressure, one of the control buttons 44 can be activated, but stiff enough to prevent the control button from accidental activation. In this embodiment, the cover 22 is preferably a clear transparent window.

In another example embodiment, the rim 20 of the first frame 12A has an adhesive exterior surface 20X. The rim 20 adheres directly to key fob face 42. Attaching the key fob protector 10 adhesively onto the key fob 10 advantageously allows a blade 48 of a key fob 10 to be retracted into the key fob.

Generally, the rims 20 of the key fob protector 10 follow the outline of the key fob face 42, such that the key fob protector fits flush on top of the key fob. However, some key fobs 40 have a special button, referred to as a panic button 46 that is activated so that the vehicle lights flash, or the alarm sounds or, in some cases, the doors lock. It is important for the panic button 46 be instantaneously accessible in case of an emergency. For those vehicles that have the panic button 46, the key fob protector 10 creates a gap 26 for the panic button 46, leaving the panic button uncovered and instantly accessible when needed. Because pressing the panic button 46 instantly alerts a user, the user is aware of any accidental activation and can correct the situation.

In the illustrations, the panic button 46 is towards the top of key fob 40. Some vehicle manufacturers may place the panic button 46 below the control buttons 44. Since each vehicle manufacturer produces key fobs 40 of different shapes and button layouts, the shape of the key fob protector 10 is customizable to accommodate those variations. It is understood by those of ordinary skill in the art that when the panic button 46 is positioned differently than in the figures, the gap 26 is positioned over the panic button 46.

Figure 5:
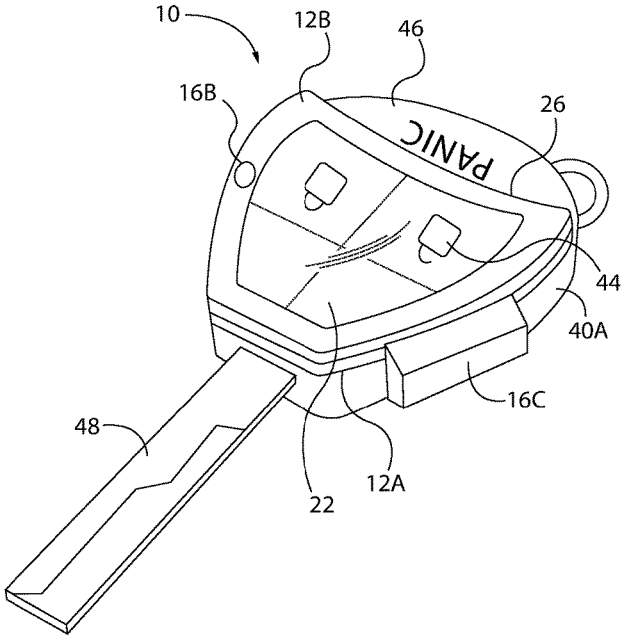
FIG. 5 is a perspective view of another example embodiment of the closed key fob protector on another key fob example.

FIG. 5 illustrates how the key fob protector 10 is further customized. The key fob 40A in the drawing is smaller, having a different shape fewer control buttons 44 and a panic button. The first frame 12A and its mirror-image second frame 12B conform to the shape of the key fob 40. The gap 26 is in place over the panic button 46. It is understood by those of ordinary skill in the art that key fob protector is customizable to accommodate various shapes and sizes of key fobs, including those with key blades 48. The various fasteners, such as the pair of magnets 16B or the sliding latch 16C functions regardless of shape and size of the fob 40A.

In another example embodiment of the key fob, the pair of frames form a pocket with a top opening and a bottom opening. The first frame sits behind the key fob opposite the key fob face and the second frame covers the key fob face. The frames have side edges at the rim and the side edges of the first frame join the side edges of the second frame defining the pocket. The key fob selectively inserts into the pocket, the blade of the key protruding through the bottom of the pocket. In this embodiment, the second frame has a center resilient transparent panel covering the buttons on the key fob. In another example embodiment, the edges of the frame selectively close and open, rather than inserting the fob, the frames wrap around the key fob.

Referring to FIGS. 1-4, the user attaches the key fob protector 10 to the key fob 40. In one example embodiment, the strap 18 wraps around the key fob 40 and fastens. In another example embodiment, the exterior surface 20X of the rim 20 of the first frame 12A adhesively adheres to the key fob face 42.

The user engages a control button 44 on the key fob 40 by separating the first frame 12A from the second frame 12B, exposing the key fob buttons 44. The user engages one or more buttons 44, locking or unlocking the vehicle, starting the engine, sliding the van doors open or popping the trunk lid.

The user rotates the second frame 12B back over the first frame 12A, the mirror images attaching by the fastener 16, covering the control buttons 44. The user can safely stow the key fob 40 in a purse, bag, pocket or other containers, knowing that none of the control buttons 44 will be inadvertently activated.

If the user needs help, the user presses the panic button 46 that is exposed by the gap 26.

It is understood that when an element is referred hereinabove as being "on" another element, it can be directly on the other element or intervening elements may be present therebetween. In contrast, when an element is referred to as being "directly on" another element, there are no intervening elements present.

Moreover, any components or materials can be formed from a same, structurally continuous piece or separately fabricated and connected.

It is further understood that, although ordinal terms, such as, "first," "second," "third," are used herein to describe various elements, components, regions, layers and/or sections, these elements, components, regions, layers and/or sections should not be limited by these terms. These terms are only used to distinguish one element, component, region, layer or section from another element, component, region, layer or section. Thus, "a first element," "component," "region," "layer" or "section" discussed below could be termed a second element, component, region, layer or section without departing from the teachings herein.

Spatially relative terms, such as "beneath," "below," "lower," "above," "upper" and the like, are used herein for ease of description to describe one element or feature's relationship to another element(s) or feature(s) as illustrated in the figures. It is understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device can be otherwise oriented (rotated 90 degrees or at other orientations) and the spatially relative descriptors used herein interpreted accordingly.

Example embodiments are described herein with reference to cross section illustrations that are schematic illustrations of idealized embodiments. As such, variations from the shapes of the illustrations as a result, for example, of manufacturing techniques and/or tolerances, are to be expected. Thus, example embodiments described herein should not be construed as limited to the particular shapes of regions as illustrated herein, but are to include deviations in shapes that result, for example, from manufacturing. For example, a region illustrated or described as flat may, typically, have rough and/or nonlinear features. Moreover, sharp angles that are illustrated may be rounded. Thus, the regions illustrated in the figures are schematic in nature and their shapes are not intended to illustrate the precise shape of a region and are not intended to limit the scope of the present claims.

In conclusion, herein is presented a key fob protector. The disclosure is illustrated by example in the drawing figures, and throughout the written description. It should be understood that numerous variations are possible, while adhering to the inventive concept. Such variations are contemplated as being a part of the present disclosure.

What is claimed is:

1. A key fob protector in combination with a key fob for preventing accidently pressing a key fob button, comprising:

a first frame attached to the key fob, the first frame having an opening exposing a plurality of buttons on a key fob face;

a second frame hingedly attaching to the first frame, the second frame having a panel therein and closing over the key fob face by contacting the first frame; and a fastener, the fastener locking the second frame to the first frame, closing the key fob protector.

2. The key fob protector as described in claim 1, wherein the first frame attaches to the key fob face by an adhesive.

3. The key fob protector as described in claim 1, wherein the first frame attaches to the key fob by a strap.

4. The key fob protector as described in claim 3, wherein the strap attaching the first frame to the key fob has a hook and loop closure.

5. The key fob protector as described in claim 1, wherein the first frame and the second frame each have a rim, the rim of the first frame configured as a mirror image to the rim of the second frame.

6. The key fob protector as described in claim 5, wherein the rim on the first frame has at least one fastener matched to at least one fastener on the second frame, the fasteners configured for locking the second frame to the first frame, closing the key fob protector.

7. The key fob protector as described in claim 6, wherein the fasteners on said rims of said frames are a pair of magnets.

8. The key fob protector as described in claim 6, wherein the fasteners on said rims of said frames are a plurality of hook and loop fastener strips.

9. The key fob protector as described in claim 6, wherein the fasteners on said rims form a sliding latch.

10. The key fob protector as described in claim 1, wherein the panel in the second frame is pliable, allowing a key fob button to be pressed when the key fob protector is closed.

11. The key fob protector as described in claim 10, wherein the panel is a transparent window.

12. The key fob protector as described in claim 1, wherein the rims of the frames have a gap, the gap configured for exposing a panic button on the key fob face.

13. A key fob protector in combination with a key fob for preventing accidently pressing a key fob button, comprising:

a pair of hingedly connected mirror image frames, a first frame adhering to a key fob face, having a center opening exposing a plurality of buttons on the key fob face and a second frame attached to the first frame and having a center panel covering the buttons on the key fob face when the frames fold shut; and a fastener, the fastener maintaining the frames together when the frames fold shut, closing the key fob protector.

14. The key fob protector as described in claim 13, wherein the first frame and the second frame each have rim, the rim of the first frame configured as a mirror image of the second frame.

15. The key fob protector as described in claim 14, wherein the rim on the first frame has at least one fastener matched to at least one fastener on the second frame, the fasteners configured for maintaining the second frame in contact with the first frame, closing the key fob protector.

16. The key fob protector as described in claim 15, wherein the fasteners on said rims of said frames are a pair of magnets.

17. The key fob protector as described in claim 15, wherein the fasteners on said rims of said frames are a plurality of hook and loop fastener strips.

18. The key fob protector as described in claim 15, wherein the fasteners on said rims form a sliding latch.

19. The key fob protector as described in claim 13, wherein the rims of the frames have a gap, the gap configured for exposing a panic button on a key fob.

* * * * *